US006377777B1

(12) United States Patent
Kishino et al.

(10) Patent No.: US 6,377,777 B1
(45) Date of Patent: Apr. 23, 2002

(54) FLUORINE-CONTAINING RESIN-COATED PRESSURE ROLLER AND HEAT-FIXING DEVICE

(75) Inventors: Kazuo Kishino, Kawasaki; Yasumasa Ohtsuka, Yokohama; Toshihiko Ochiai, Tokyo; Masaaki Takahashi, Asaka; Akira Hayakawa, Abiko; Hideo Kawamoto, Tokyo; Mahito Yoshioka, Toride; Osamu Soutome, Kawasaki; Kenji Karashima, Abiko; Yuji Kitano, Yokohama, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/505,690

(22) Filed: Feb. 18, 2000

(30) Foreign Application Priority Data

Feb. 19, 1999 (JP) ..... 11-042031

(51) Int. Cl.[7] ..... G03G 15/20

(52) U.S. Cl. ..... 399/329; 399/331; 399/333

(58) Field of Search ..... 399/320, 328, 399/329, 331, 332, 339; 430/97, 98, 99, 124

(56) References Cited

U.S. PATENT DOCUMENTS

| | | | | |
|---|---|---|---|---|
| 5,011,401 A | * | 4/1991 | Sakurai et al. | 399/331 X |
| 5,051,784 A | * | 9/1991 | Yamamoto et al. | 399/329 |
| 5,149,941 A | | 9/1992 | Hirabayashi et al. | 219/216 |
| 5,187,849 A | * | 2/1993 | Kobayashi | 399/320 X |
| 5,319,427 A | * | 6/1994 | Sakurai et al. | 399/333 |
| 5,331,385 A | | 7/1994 | Ohtsuka et al. | |
| 5,391,450 A | * | 2/1995 | Nagatsuka et al. | 430/99 |
| 5,608,508 A | | 3/1997 | Kumagai et al. | 399/339 |
| 5,717,988 A | | 2/1998 | Jinzai et al. | 399/333 |
| 5,722,026 A | * | 2/1998 | Goto et al. | 399/333 |
| 5,753,348 A | | 5/1998 | Hatakeyama et al. | 428/195 |
| 5,950,061 A | | 9/1999 | Ota et al. | 399/333 |
| 5,966,578 A | | 10/1999 | Soutome et al. | 399/333 |
| 6,005,594 A | | 12/1999 | Nanataki et al. | 347/156 |

FOREIGN PATENT DOCUMENTS

| | | |
|---|---|---|
| JP | 63-313182 | 12/1988 |
| JP | 02-157878 | 6/1990 |
| JP | 04-044075 | 2/1992 |
| JP | 04-044077 | 2/1992 |
| JP | 04-044078 | 2/1992 |
| JP | 04-044079 | 2/1992 |
| JP | 04-044080 | 2/1992 |
| JP | 04-044081 | 2/1992 |
| JP | 04-044082 | 2/1992 |
| JP | 04-044083 | 2/1992 |
| JP | 04-204980 | 7/1992 |
| JP | 04-204981 | 7/1992 |
| JP | 04-204982 | 7/1992 |
| JP | 04-204983 | 7/1992 |
| JP | 04-204984 | 7/1992 |
| JP | 04-044076 | 12/1992 |
| JP | 07-271233 | 10/1995 |

* cited by examiner

*Primary Examiner*—Sandra Brase
(74) *Attorney, Agent, or Firm*—Fitzpatrick, Cella, Harper & Scinto

(57) ABSTRACT

A fluorine-containing resin-coated pressure roller exhibiting excellent anti-toner soiling characteristic even at low roller temperatures is provided. The pressure roller includes a cylindrical metal substrate, and a rubber elastic layer, an adhesive layer and a fluorine-containing resin release layer disposed in this order on and successively coating the cylindrical metal substrate. The pressure roller has a surface exhibiting a micro-rubber hardness of at most 50 deg., a contact angle with water of at least 105 deg. and a ten point-average surface roughness Rz of at most 3.0 $\mu$m. The pressure roller may be suitably combined with a fixing film to provide a film heating-type fixing device suitably used in an electrophotographic image forming apparatus.

9 Claims, 3 Drawing Sheets

FLUORINE-CONTAINING RESIN-COATED PRESSURE ROLLER AND HEAT-FIXING DEVICE

FIELD OF THE INVENTION AND RELATED ART

The present invention relates to a pressure roller and a heat-fixing device including such a pressure roller for use in an electrophotographic image forming apparatus. More specifically, the present invention relates to a roller for nipping a recording material for conveying the recording material, and particularly a pressure roller used in a heat-fixing device for permanently fixing a toner image onto a recording material in a recording system according to, e.g., electrophotography or electrostatic recording.

Many of conventional electrophotographic copying machines and printers have adopted, as fixing means, those of the heat-fixing type including a contact-heating hot roller fixing device exhibiting good heat efficiency and safeness and a film-heating type fixing devices requiring less energy consumption.

A heat-fixing device of the hot roller type includes a heating roller (fixing roller) as a rotating member for heating and an elastic pressure roller as a rotating member for pressurization pressed against the heating roller as basic members. A pair of the rollers are rotated, and a recording material (such as transfer paper, electrostatic recording paper, electrofax paper or printing paper) carrying a yet-unfixed toner image conveyed to a pressure nip (fixing nip) between the rollers is nipped and passed between the rollers, whereby the toner image is heat-fixed to form a permanently fixed image on the recording material surface under the action of a heat from the heating roller and a pressure at the pressing nip.

A typical of the elastic pressure roller used for the above purpose comprises a solid or hollow cylindrical core metal or metal substrate, an elastic layer formed on the metal substrate, and a toner release layer of a fluorine-containing resin formed on the outer peripheral surface of the elastic layer. In order to ensure a sufficient contact area between the recording material and the heating roller, the pressure roller is required to exhibit a sufficient elasticity so that the elastic layer is formed in a relatively large thickness. The elastic layer frequently comprises silicone rubber in view of the heat resistance.

Fixing devices of the film-heating type are disclosed, e.g., in Japanese Laid-Open Patent Application (JP-A) 63-313182, JP-A 2-157878, JP-A 4-44075 to 4-44083 and JP-A 4-204980 to 4-204984. In a typical film-heating type fixing device, a heat-resistant film (fixing film) as a rotating member for heating is pressed against a heating member (heat-generating member) while being moved in contact with the heat-generating member by the action of a rotation member (elastic roller) for pressurization, and a recording material carrying a yet-unfixed toner image is conveyed to a pressure nip formed between the heating member and the elastic roller pressed against each other via the heat-resistant film and moved together with the heat-resistant film, thereby fixing the yet-unfixed toner image to provide a permanently fixed image on the recording material under the action of a heat imparted from the heating member via the heat-resistant film and a pressure at the pressure nip.

Such a film-heating type fixing device allows economization of electricity and shortening of a waiting time (i.e., an improved quick-start performance) as the heating member can comprise a low-heat capacity linear heating member and the heat-resistant film comprises a film of a low-heat capacity.

As fixing devices of this type, there are known those according to a scheme wherein a drive roller is disposed in contact with an inner surface of the fixing film to drive the fixing film under tension and also those according to a scheme wherein a fixing film is wound loosely about a film guide and a rotating member for pressurization is primarily driven to drive the fixing film in rotation following the rotation of the rotating member. In recent years, the latter pressure rotation member (pressure roller) drive-type devices are more frequently adopted in view of a smaller number of parts required therein.

The elastic roller used for the above purpose may frequently comprise a solid or hollow core metal or metal substrate, a silicone rubber elastic layer or a silicone sponge layer formed on the metal substrate, and further a toner release layer of a fluorine-containing resin formed directly or via an adhesive layer thereon. In the commercial devices, the fluorine-containing resin layer has been given as a coating formed of a tube of fluorine-containing resin or formed by applying and baking a paint of fluorine-containing resins. In order to ensure a sufficient contact area between the recording material and the heating member, the pressure roller is required to exhibit a sufficient elasticity so that the elastic layer is formed in a relatively large thickness.

In recent years, not only in the above-mentioned pressure roller-drive type film-heating fixing device, but also in the hot roller fixing device and the fixing film-drive type film-hating fixing device, a higher-speed operation is strongly desired and also the adaptability to providing a smaller-size image forming apparatus is demanded. Further, for realizing economization of electricity, the demand for a heat-fixing device exhibiting an improved heat efficiency without requiring a standby temperature control is also increasing.

For complying with such demands for fixing devices, it is inevitably required to use a fixing roller and a pressure roller of relatively smaller diameters and operated at a relatively low pressure. Accordingly, in the case of an image forming apparatus operated at a high recording material-conveying speed, it becomes necessary to provide a broader pressure nip between the fixing roller or fixing film and the pressure roller at a low pressure in order to supply a sufficient heat to the recording material. For this reason, it has been tried to develop a pressure roller having a lower roller hardness.

For example, as a low-hardness fixing pressure roller, JP-A 7-271233 has proposed a fixing pressure roller comprising a silicone rubber layer formed from liquid silicone and having hollow pores continuous in its longitudinal direction, and also a fluorine-containing resin layer formed on the silicone rubber layer and having a surface hardness of at most 60 deg. as measured by an Asker-C hardness meter (1 kg-f).

JP-A 7-271233 has proposed a pressure roller having an elastic layer comprising a porous silicone rubber sponge layer having a hardness of 35–50 deg. (Asker-C) and a tube of PFA (tetrafluoroethyleneperfluoroalkyl vinyl ether copolymer) coating the sponge layer, thus providing an entire roller hardness (Asker-C) of 45–60 deg. so as to exhibit a good fixing performance while preventing the occurrence of paper wrinkles.

The above-mentioned JP-A 63-313182 and JP-A 2-157878 disclose a film-heating fixing device including a heating unit comprising at least a fixedly supported heating member (heater) and a cylindrical heat-resistant film for fixation conveyed while being pressed against the heating member, and a pressing member for pressing a recording material against the heating member, so as to transmit a heat from the heating member to the recording material via the film, thereby heat-fixing a yet-unfixed toner image carried on the recording material onto the recording material surface.

An example of such a heat-fixing device is illustrated in FIG. 3. Referring to FIG. 3, the fixing device includes a cylindrical film 101 comprising a 40 to 60 $\mu$m-thick polyimide base film and a 40 to 60 $\mu$m-thick release layer of PFA (tetrafluoroethylene-alkyl vinyl ether copolymer) alone or in mixture with PTFE (polytetrafluoroethylene) dispersed in PFA formed thereon for constituting an outer layer contacting a recording material P and a toner image T thereon.

The fixing device also includes a heating member (heater) 102, which basically comprises an insulating, heat-resistant and low-heat capacity ceramic substrate extends in a longitudinal direction perpendicular to the conveyance direction for the recording material P and a resistive heating member printed in the longitudinal direction on the ceramic substrate, and a temperature-detecting device 103 (of a thermistor, etc.) disposed in contact with and on a surface of the substrate opposite to the exposed resistive heating member.

The heater 102 is fixedly supported by a film guide (heater stay) 104 having an arcuate section so as to expose its heating member toward the film 101 and be otherwise insulated. The temperature of the heater 102 is controlled by controlling a current supply to the resistive heating member from a power supply (not shown) depending on an output from the temperature-detecting device 103.

The fixing device further includes a reverse U-shaped reinforcing metal sheet 108 for preventing deformation of the heater unit including the heater 102, the thermistor 103, the film guide 104, etc., under a pressure exerted by the pressure roller 105. The film 101 is designed to have an inner circumferential length larger than the peripheral length of the film guide 104 and the reinforcing metal sheet 108.

The pressure roller 105 is composed of a core metal 106 and a heat-resistant rubber layer 107 and is pressed against the heater 102 at a total pressure of 5–15 kg-f by being supported by a supporting means (not shown). The pressure roller 105 is driven in rotation in a counterclockwise direction by a drive means (not shown), whereby the film 101 is moved relative to and in intimate contact with the heater 102 and rotated in a clockwise direction around the film guide 104. In this instance, heat-resistant grease is caused to be present between the heater 102 and the film 101 so as to reduce the friction between these members.

As a result, a recording material P is guided to between the film 101 and the pressure roller 105 to be pressed through a nip N therebetween, whereby a toner image T on the recording material P is heat-fixed onto the recording material.

The above-mentioned film-heating fixing device is allowed to have a heat capacity of the heater unit which is one several tenth that of the conventional hot roller fixing device, and also a heat-generating member capable of quick temperature rise, so that the heating member can reach a fixing temperature within several seconds to ten and several seconds. Accordingly, it becomes possible to effect the so-called on-demand fixation that has been difficult to realize by the hot-roller fixing device.

In the film-heating fixing device, a thermistor 103 is abutted onto a side of the heater 102 opposite to the side provided with a printed resistive heat-generating member to detect an abnormal temperature rise of the heater 102, and data therefrom is transferred to a control means so as to control a switching device (not shown) to interrupt a current supply to the heating member.

However, in some cases of using a conventional pressure roller in such a film heating-type fixing device to operate the fixing device intermittently in a low temperature environment, the pressure roller surface is liable to be soiled with the toner to frequently result in difficulties, such as disorder of fixed images, paper wrinkles and paper winding about the pressure roller.

The toner solid on the pressure roller is observed to be initiated by attachment of paper dust which functions as nuclei for accumulation of the toner transferred from the fixing film. It has been confirmed that the paper dust attachment is more frequently caused when the pressure roller is driven at a lower surface temperature. In a heat-fixing device of electricity economization-type having no standby temperature control means, the pressure roller surface is caused to contact transfer paper (recording material) before the surface is warmed, so that paper dust attachment is liable to occur.

The paper dust attachment at a lower pressure roller surface temperature is also provided by a mechanism as follows. Paper dust is also attached onto toner already attached onto the pressure roller surface. In this instance, if the pressure roller surface is sufficiently heated, the toner is softened and is attached to transfer paper conveyed thereto so that paper dust can be removed easily together with the toner. However, if the pressure roller surface is not sufficiently heated, it is difficult to effect paper dust removal according to such mechanism.

Further, as mentioned above, in the film heating-type fixing device expected to perform electricity economization and shorter waiting time (i.e., improved quick-start characteristic), the heating member (fixing film) has a small heat capacity so that the pressure roller cannot be easily heated, and also in view of a demand for a smaller-size image forming apparatus, it is required to use a fixing film and a pressure roller of small diameters operated at a low pressure, so that it becomes difficult to obviate electrostatic offset. Particularly during an intermittent operation in a low temperature environment, the amount of toner offset to the fixing film is liable to be increased. This is presumably because of the following mechanism.

Toner transferred and attached to transfer paper is subject to an electrostatic force of attraction onto the fixing film. The electrostatic attraction force is for example caused by transfer of a charge of the transfer paper for attracting the toner to the fixing film surface. In case where the pressure roller surface is sufficiently heated, the toner on the transfer paper is heated not only by heat from the fixing film but also by heat from the pressure roller via the transfer paper, so that the toner on the transfer paper is sufficiently softened to generate a viscous adhesive force, by which the offset of the toner onto the fixing film is effectively prevented. However, in case where the pressure roller surface is not sufficiently heated, heat supply from the pressure roller is scarce and the toner is not sufficiently softened to generate a viscous adhesive force, so that a portion of the toner on the transfer paper can be electrostatically offset onto the fixing film surface. The offset toner onto the fixing film can be transferred to and accumulated on the pressure roller, thus being liable to cause difficulties, such as fixed image disorder, paper wrinkles and paper winding about the pressure roller.

The conventional pressure rollers have been developed to have a lower hardness of the entire roller so as to ensure fixing and conveying performance, and have been unsatisfactory for obviating paper dust attachment onto the roller surface.

Further, many of the fixing devices developed heretofore are not equipped with a cleaning device therefor for the propose of cost reduction, etc. Further, the use of smaller particle size toner for providing higher quality images in recent years makes difficult the cleaning by such cleaning means and has promoted the paper dust attachment. On the other hand, for the purpose of improving storage stability for a long period of paper, acidic paper has been gradually replaced by neutral paper, and accompanying therewith, calcium carbonate is being popularly used as paper filler. Further, a larger percentage of recently produced paper inclusive of regenerated paper tends to contain plural species of inorganic materials, such as calcium carbonate and talc, as paper fillers.

Such a filler is however liable to be attached onto the pressure roller, the fixing roller or fixing film, etc., thereby lowering the releasability of these members, so that the toner is liable to be accumulated on the pressure roller to result in spotty defects in the resultant images, and a difficulty such as paper winding about the pressure roller, leading to paper jamming, is liable to be caused.

SUMMARY OF THE INVENTION

A principal object of the present invention is to provide a pressure roller for use in a heat-fixing device of an electrophotographic image forming apparatus having solved the above-mentioned problems.

A more specific object of the present invention is to provide a pressure roller exhibiting stable releasability free from surface soiling for a long period even in an intermittent operation in a low temperature environment, thus exhibiting long-term durability and appropriate degree of gripping performance so as to retain good recording material conveying performance.

Another object of the present invention is to provide a pressure roller satisfying required fixing performance and durability and also capable of effectively suppressing toner sticking onto the roller surface, thus obviating difficulties, such as image soiling and paper jamming.

A further object of the present invention is to provide a heat-fixing device including such a pressure roller and exhibiting a high reliability in a long term use.

According to the present invention, there is provided a fluorine-containing resin-coated pressure roller, comprising a cylindrical metal substrate, and a rubber elastic layer, an adhesive layer and a fluorine-containing resin release layer disposed in this order on and successively coating the cylindrical metal substrate; wherein the pressure roller has a surface exhibiting a micro-rubber hardness of at most 50 deg., a contact angle with water of at least 105 deg. and a ten point-average surface roughness Rz of at most 3.0 $\mu$m.

If the pressure roller has a surface exhibiting such a low hardness and rich in softness, it is considered that the roller surface can repetitively cause circumferential elongation and contraction of the nip and in the neighborhood thereof, so that paper dust is less liable to attach to the roller surface and paper dust once attached to the roller surface due to static electricity, etc., can be released therefrom. Accordingly, it becomes possible to prevent toner soiling on the pressure roller surface caused by attached paper dust. On the other hand, if the pressure roller surface has a micro-rubber hardness exceeding 50 deg., it becomes difficult to attain the above effect due to insufficient circumferential elongation and contraction of the pressure roller surface at and in the neighborhood of the nip.

Further, by setting the pressure roller surface to exhibit a contact angle with water of at least 105 deg., the pressure roller surface is caused to have a lower surface energy, thereby reducing the attachment of paper dust and toner.

Further, by setting the pressure roller surface to have a roughness Rz of at most 3.0 $\mu$m, it becomes possible to prevent the intrusion of toner into concavities of the roller surface leading to formation of nuclei of further toner and paper dust attachment.

As a result of synergistic combination of the above-mentioned effects attributable to prescribed physical properties, the pressure roller of the present invention is believed to exhibit good conveying performance without toner attachment.

According to another aspect of the present invention, there is provided a heat-pressure fixing deice including the above-mentioned fixing device.

The pressure roller of the present invention is particularly effectively used in a film-heating type fixing device. Thus, according to still another aspect of the present invention, there is provided a film heating-type fixing device for use in an electrophotographic image forming apparatus, comprising: a fluorine-containing resin-coated elastic pressure roller and a fixing film having a surface release layer disposed opposite to the pressure roller surface, wherein the surface release layer of the fixing film comprises a fluorine-containing resin and exhibits a ten point-average surface roughness Rz of at most 5 $\mu$m; and the fluorine-containing resin-coated pressure roller comprises a cylindrical metal substrate, and a roller elastic layer, an adhesive layer and a fluorine-containing resin release layer disposed in this order on and successively coating the cylindrical metal substrate; wherein the pressure roller has a surface exhibiting a micro-rubber hardness of at most 50 deg., a contact angle with water of at least 105 deg. and a ten point-average surface roughness Rz of at most 3.0 $\mu$m.

These and other objects, features and advantages of the present invention will become more apparent upon a consideration of the following description of the preferred embodiments of the present invention taken in conjunction with the accompanying drawings.

PREFERRED EMBODIMENTS OF THE INVENTION

Figure 1:
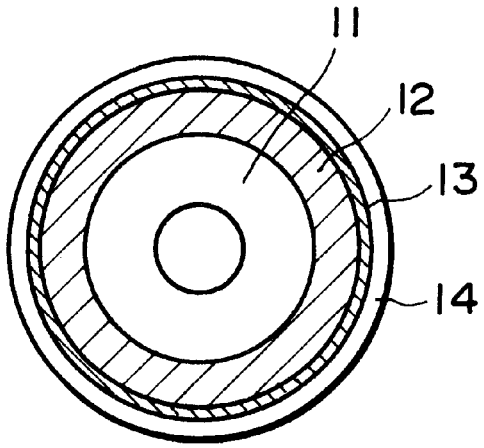
FIG. 1 is a schematic sectional view of an embodiment of the pressure roller according to the invention.

It is preferred that the pressure roller of the present invention exhibits a surface micro-rubber hardness of at least 10 deg. in view of wear resistance.

It is preferred that the surface of the pressure roller exhibits a contact angle with water of 105–130 deg.

It is also preferred that the fluorine-containing resin-coated pressure roller of the present invention exhibits a ten point-average surface roughness of 0.1–3.0 μm.

The fluorine-containing resin-coated pressure roller of the present invention may preferably include an elastic layer comprising a silicone rubber exhibiting a JIS-A hardness of 5–25 deg.

Further, it is preferred that the surface fluorine-containing resin layer has a thickness of 1–10 μm, and the adhesive layer therebelow has a thickness of 5–18 μm.

The adhesive layer may preferably comprise rubbery elastic material (or elastomer) containing fluorine-containing resin powder therein and exhibiting a JIS-A rubber hardness of 30–75 deg.

The values of "micro-rubber hardness" of a pressure roller surface described herein are based on values measured according to JIS K-6253 "Micro-test" and represent a hardness of a portion in relative proximity to the pressure roller surface. In the measurement, a commercially available micro-rubber hardness meter ("Microhardness Meter MD-1", mfd. by Ko-bunshi Keiki K.K.) distributed as a ⅕ reduced size model of spring-type rubber hardness meter (durometer) was used.

Further, the contact angle values described herein are based on values measured by using a contact angle meter ("Contact Angle Meter CA-X type", mfd. by Kyowa Kaimen Kagaku K.K.).

The surface hardness of a pressure roller is principally generated by a combined contribution of a material hardness and a thickness of the adhesive layer, and a thickness of the fluorine-containing resin release layer. The adhesive layer may have an arbitrary hardness as far as it is higher than that of the elastic layer material. If the hardness of the adhesive layer material is equal to or below that of the elastic layer material, an excessively large hardness difference is liable to be present between the fluorine-containing resin release layer and the adhesive layer, so that a stress concentration is liable to occur at the time of roller deformation at the nip, leading to a lowering in adhesion durability in some cases. The adhesive layer may ordinarily have a thickness selected in the range of 3–35 μm, and the fluorine-containing resins release layer may ordinarily have a thickness selected in the range of 1–20 μm, so that the pressure roller surface exhibits a micro-rubber hardness of at most 50 deg. In order to realize a combination of the required surface smoothness and the surface softness, it is preferred to apply a surface smoothing treatment after the lamination of the fluorine-containing resin release layer.

It is preferred that the pressure roller surface exhibits a contact angle with water of at most 130 deg. or a surface roughness (ten point-average) Rz of at least 0.1 μm. This is because the surface roughness of below 0.1 μm to provide a contact angle exceeding 130 deg. requires a rather long surface smoothing treatment.

The value of ten point-average surface roughness Rz referred to herein are based on values measured according to JIS B-0601. More specifically, a sample surface is subjected to measurement of a surface roughness by using a surface roughness meter ("SE-3400", mfd. by K.K. Kosaka Kenkyusho) to obtain a surface roughness curve, a portion of which is taken out for a reference length (0.8 mm herein) along an average line. Along the taken-out portion of roughness curve, the highest 5 peaks and the lowest 5 valleys are selected to determine the height differences thereof (Yp1 to Yp5 and Yv1 to Yv5) relative to the average line. Then, Rz is determined according to the following formula:

$$Rz=|Yp1+Yp2+Yp3+Yp4+Yp5|/5+|Yv1+Yv2+Yv3+Yv4+Yv5|/5.$$

In the fluorine-containing resin-coated pressure roller of the present invention, it is preferred that the fluorine-containing resin surface layer has a thickness of 1–10 μm and the adhesive layer has a thickness of 5–18 μm.

The expansion and contraction of the pressure roller surface may be affected by the hardness of the adhesive layer. However, if the fluorine-containing resin layer thickness is in the range of 1–10 μm and the adhesive layer thickness is in the range of 5–18 μm, the expansion and contraction characteristic required for preventing paper dust attachment can be ensured if the adhesive layer material exhibits a hardness exceeding 90 deg.

In the fluorine-containing resin-coated pressure roller of the present invention, it is preferred that the adhesive layer comprises a rubbery elastic material containing fluorine-containing resin powder dispersed therein, and the material thereof as a whole exhibits a JIS-A rubber hardness of 30–75 deg.

The fluorine-containing resin powder is effective for improving the adhesion with the fluorine-containing resin release layer and may comprise at least one species of fluorine-containing resins inclusive of polytetrafluoroethylene (PTFE), tetrafluoroethylene-perfluoroalkyl vinyl ether copolymer (PFA), and tetrafluoroethylene-hexafluoropropylene copolymer (FEP). In view of heat resistance and adhesiveness, FEP is most preferred. The content of the fluorine-containing resin is not particularly limited as far as required adhesiveness is ensured, but an amount in the range of 70–130 wt. parts per 100 wt. parts of the rubber component may be preferred.

If the elastomeric material containing the fluorine-containing resin powder constituting the adhesive layer has a JIS-A rubber hardness not exceeding 75 deg., it is possible to ensure the expansion and contraction characteristic of the pressure roller surface required for preventing paper dust attachment. On the other hand, below 30 deg., there may arise a large hardness difference between the fluorine-containing resin release layer and the adhesive layer, so that a stress concentration can occur at the boundary therebetween at the time of roller deformation at the nip, thus leading to a problem regarding the durability of adhesion.

FIG. 1 is a schematic sectional view of an embodiment of the fluorine-containing resin-coated pressure roller according to the present invention.

Referring to FIG. 1, the pressure roller includes a cylindrical metal substrate 11 of iron, aluminum, etc. The cylindrical substrate 11 is coated sequentially with an elastic layer 12 comprising silicone rubber having a JIS-A hardness of 5–25 deg., an adhesive layer 13 and a release layer 14 of a fluorine-containing resin, such as PTFE, PFA or FEP.

Figure 2:
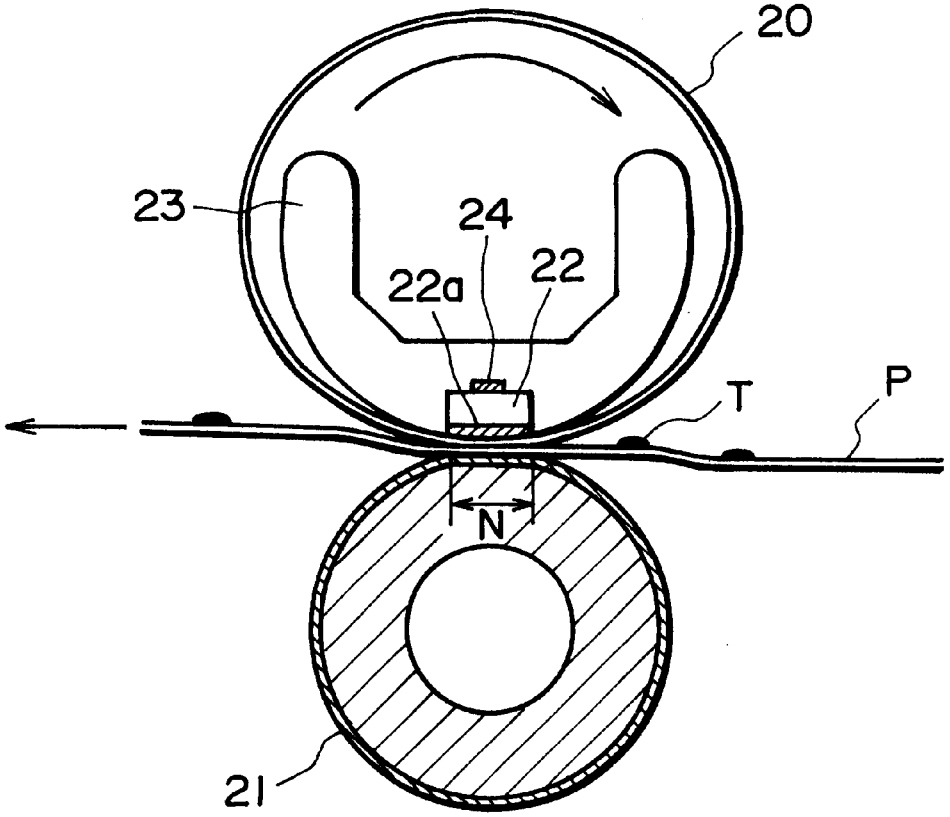
FIG. 2 is a schematic sectional view of an embodiment of the film heating-type fixing device according to the invention.

FIG. 2 is a schematic sectional view of an embodiment of the film heating-type fixing device according to the present invention.

Referring to FIG. 2, the fixing device includes an endless belt-form heat-resistant film (fixing film) 20 disposed so as to surround a semi-circular arcuate film-guide member (stay) 23 with a circumferential length margin.

The fixing film 20 may be formed in a total thickness of at most 100 μm, preferably 20–60 μm, so as to have a small heat capacity suitable for providing an improved quick-start characteristic. The fixing film 20 may be in a form of a single layer film of a resin, such as PTFE, PFA or polyphenylene sulfide, exhibiting heat-resistance, releasability, strength and durability, or a composite film formed from a film of polyimide, polyamide imide, polyether ether ketone (PEEK) or polyethersulfone (PES) coated with a release layer of a fluorine-containing resin, such as PTFE, PFA or tetrafluoroethylene-hexafluoropropylene copolymer, optionally via a fluorine-containing resin-type primer. The release layer may preferably exhibit a surface roughness Rz of at most 5 $\mu$m.

The fixing device also includes a pressure roller 21 according to the present invention, which comprise an elastic layer, an adhesive layer and a fluorine-containing resin layer successively disposed in this order on a cylindrical metal substrate of iron, aluminum, etc. The pressure roller 21 has a surface exhibiting a micro-rubber hardness of at most 50 deg.

In the fixing device of FIG. 2, along with the rotation of the pressure roller 21, the fixing film 20 is driven in rotation in a clockwise direction indicated by an arrow while intimately contacting and rubbing a heating member 22 surface at least at the time of executing image fixation, at a prescribed circumferential speed almost identical to a speed of conveyance of a transfer material (or recording paper) P carrying a yet unfixed toner image T supplied from an image forming unit (not shown), thus in a wrinkle-free state.

The heating member 22 includes a current conduction heat-generating member (resistive heat-generating member) 22*a* as a heat source for generating heat under electricity supply, and is elevated in temperature due to the generated heat from the heat-generating member 22*a*.

In the state of the heating member 22 being heated under electricity supply to the heat-generating member 22 and the fixing film 20 being driven in rotation, the pressure roller 21 is pressed against the heating member 22 via the fixing film 20 to deform the elastic layer of the pressure roller 21 thus forming a pressure nip N (fixing nip) with the hating member 22, and the transfer material P is introduced and passed through the fixing nip N in intimate contact with the film 20 and in superposition with the film 20.

During the passage of the transfer material P through the fixing nip, the transfer material P is supplied with heat energy from the heating member 22 via the film 20, whereby the toner image T on the transfer material is heat-melted to be fixed onto the transfer material P, and then the transfer material carrying the fixed toner image after passing through the fixing nip is separated from the film 20 and discharged out of the fixing device.

Hereinbelow, the present invention will be described more specifically based on Examples and Comparative Examples.

EXAMPLE 1

Four pressure rollers (Examples 1-1 to 1-4) each having a structure as shown in FIG. 1 were prepared as follows.

A 2 mm-thick aluminum core cylinder was coated with an elastic layer of silicone rubber ("DY35-561A/B", mfd. by Toray Dow Corning Silicone K.K.) in a thickness of 2.5 mm, a length of 225 mm and an outer diameter of 20 mm). After being treated with a primer, the coated cylinder was further coated successively with an adhesive layer of a fluorine-containing rubber/fluorine-containing resin mixture and a release layer of fluorine-containing resin having thicknesses shown at Examples 1-1 to 1-4 in Table 1 appearing hereinafter. Each adhesive layer was formed by application of a solution in methyl isobutyl ketone of the following formulation A, followed by drying and curing. The formulation A after curing exhibited a hardness of 90 deg.

Formulation A

| | |
|---|---|
| Unvulcanized fluorine rubber ("G501", mfd. by Daikin Kogyo K.K.) | 100 wt. parts |
| MT Carbon ("Thermax N-990", Cancarb Co.) | 5 " |
| Magnesium oxide ("Kyowa Mag MA-150", mfd. by Kyowa Kagaku Kogyo K.K.) | 15 " |
| N,N-dicinnamylidene-1,6-hexadiamine | 6 " |
| FEP powder ("532-8000", mfd. by E. I. Dupont) | 100 " |

The surface release layer was formed by application of an FEP dispersion liquid ("ND1", mfd. by Daikin Kogyo K.K.) followed by drying and baking.

The thus-produced pressure roller exhibited a surface roughness Rz of 5 $\mu$m and subjected to a surface smoothing treatment as follows. The pressure roller was inserted into a polyimide tube having a smooth inner surface wall and an inner diameter almost identical to the outer diameter of the pressure roller, and the resultant structure was heated at 270° C. for 2 minutes, during which the surface was pressed against the inner wall of the polyimide tube due to thermal expansion of the aluminum cylinder. As a result, the pressure roller taken out of the polyimide tube after cooling exhibited a reduced surface roughness Rz of 1 $\mu$m. The surface layer exhibited a contact angle of 110 deg.

COMPARATIVE EXAMPLE 1

Three pressure rollers (Comparative Examples 1-1 to 1-3) were prepared in the same manners as in Example 1 except that the thicknesses of the adhesive layer and the surface layer were changed as shown at Examples 1-1 to 1-3 in Table 1.

Further, a pressure roller of Comparative Example 1-4 was prepared in a similar manner as in Example 1-2 except that the elastic layer was formed of silicone rubber ("DY35-560A/B", mfd. by Toray Dow Corning Silicone K.K.), and the surface layer was formed of a PFA tube overlapping the adhesive layer and not subjected to the surface-smoothing treatment. The pressure roller exhibited a surface roughness Rz of 0.8 $\mu$m, and a contact angle of 108 deg.

TABLE 1

| | Elastic layer*1 | Adhesive layer | | Surface layer | | Surface | Roller |
|---|---|---|---|---|---|---|---|
| Example | hardness*1 (deg.) | hardness*2 (deg.) | thickness ($\mu$m) | material | thickness ($\mu$m) | hardness*3 (deg.) | hardness*4 (deg.) |
| Ex.1-1 | 22 | 90 | 23 | FEP | 2 | 48 | 53 |
| Ex.1-2 | 22 | 90 | 20 | FEP | 5 | 48 | 53 |
| Ex.1-3 | 22 | 90 | 20 | FEP | 11 | 49 | 54 |

TABLE 1-continued

| Example | Elastic layer*1 hardness*1 (deg.) | Adhesive layer hardness*2 (deg.) | Adhesive layer thickness (μm) | Surface layer material | Surface layer thickness (μm) | Surface hardness*3 (deg.) | Roller hardness*4 (deg.) |
|---|---|---|---|---|---|---|---|
| Ex.1-4 | 22 | 90 | 10 | FEP | 4 | 46 | 52 |
| Conp. Ex. 1-1 | 22 | 90 | 20 | FEP | 18 | 52 | 56 |
| Conp. Ex. 1-2 | 22 | 90 | 60 | FEP | 5 | 53 | 55 |
| Conp. Ex. 1-3 | 22 | 90 | 40 | FEP | 11 | 53 | 55 |
| Conp. Ex. 1-4 | 15 | 90 | 20 | PFA*5 | 30 | 56 | 50 |

*1Silicone rubber
*2JIS-A rubber hardness
*3Micro-rubber hardness
*4Asker-C hardness
*5PFA tube

EXAMPLE 2

Two pressure rollers (Examples 2-1 and 2-2) were prepared in a similar manner as in Example 1.

More specifically, an aluminum cylinder coated with a silicone rubber layer and a primer similarly as in Example 1 was further coated with an adhesive layer (of a fluorine-containing rubber/fluorine-containing resin mixture) and a release layer of fluorine-containing resin having thickness (at Example 2-1 or Example 2-2) in Table 2. The adhesive layers in Examples 2-1 and 2-2 were formed by application of solutions of the following formulations B and C, respectively, followed by drying and curing. After curing, the adhesive layers exhibited JIS-A rubber hardness of 73 deg. and 70 deg., respectively.

Formulation B

| | |
|---|---|
| Unvulcanized fluorine-containing rubber ("G-501") | 100 wt. parts |
| MT carbon ("Thermax N-990") | 0 " |
| Magnesium oxide ("Kyowa Mag MA-150") | 15 " |
| N,N-dicinnamylidene-1,6-hexadiamine | 1.5 " |
| FEP powder ("532-8000") | 100 " |

Formulation C

| | |
|---|---|
| Unvulcanized fluorine-containing rubber (containing polyol crosslinking agent, "G621", mfd. by Daikin Kogyo K.K.) | 100 wt. parts |
| MT carbon ("Thermax N-990") | 0 " |
| Calcium hydroxide ("CALDIC-2000", mfd. by Ohmi Kagaku Kogyo K.K.) | 2 " |
| Magnesium oxide ("Kyowa Mag MA-150") | 3 " |
| FEP powder ("532-8000") | 100 " |

For each pressure roller, the surface layer was formed by applying a PFA dispersion liquid ("AD-2", mfd. by Daikin Kogyo K.K.), followed by drying, baking and a surface-smoothing treatment at 300° C. for 3 min. otherwise in the same manner as in Example 1. The surface release layer exhibited a surface roughness Rz of 7 μm before the smoothing treatment, and a surface roughness Rz of 1.0 μm and a contact angle of 105 deg after the smoothing treatment.

TABLE 2

| Example | Elastic layer* hardness*1 (deg.) | Adhesive layer hardness*2 (deg.) | Adhesive layer thickness (μm) | Surface layer material | Surface layer thickness (μm) | Surface hardness*3 (deg.) | Roller hardness*4 (deg.) |
|---|---|---|---|---|---|---|---|
| 2-1 | 22 | 73 | 34 | PFA | 2 | 46 | 52 |
| 2-2 | 22 | 70 | 32 | PFA | 2 | 43 | 51 |

*1~*4Same as in Table 1

Each of the pressure rollers prepared in the above Examples and Comparative Examples was incorporated as a pressure roller 21 in a film hating-type fixing device shown in FIG. 2 and subjected to performance evaluation.

The fixing film 22 used comprised a 40 μm-thick seamless film of 25 mm in outer diameter, coated with a 5 μm-thick fluorine-containing primer and a liquid dispersion of fluorine-containing resin (PTFE/PFA (=50/50) mixture), followed by baking, and cut in a length of 230 mm. The fluorine-containing resin layer surface was finished to a surface roughness Rz of 4.5 μm.

Each pressure roller was incorporated together with the fixing film in the fixing device and used for fixation of unfixed toner images carried on A4-size paper sheets formed by a commercially available laser beam printer ("Laser Shot LBP320", mfd. by Canon K.K.). The pressure roller was rotated at a peripheral speed of 90 mm/sec, and electricity of 900 W was supplied to the heating member only at the time of paper supply, to effect a fixing test on 5000 sheets intermittently supplied with a standing time of 10 min. each after supply of 2 sheets in a low temperature/low humidity (=15° C./10% RH) enironment where electrostatic offset is liable to occur. During the test, the pressure roller surface temperature never exceeded 80° C.

During the test, the pressure rollers of Examples 1-1, 1-2 and 1-3 caused no conveyance trouble and exhibited only slight paper dust attachment and no toner soiling on the pressure roller surface after the test. The pressure rollers of Examples 1-4, 2-1 and 2-2 were free from any of conveyance trouble during the test and paper dust attachment and toner soiling on the pressure roller surface after the test.

On the other hand, the pressure rollers of Comparative Examples 1-1 to 1-4 all exhibited a substantial amount of attached toner soiling on the pressure roller surface after the fixing test on 5000 sheets.

EXAMPLE 3

An aluminum cylinder of 260 mm in length was coated with a 3.5 mm-thick elastic layer of silicone rubber ("DY35-561A/B") to provide a roller of 20 mm in outer diameter and 230 mm in coated elastic layer length. The coated roller was further coated with an adhesive (GLP-103", mfd. by Daikin Kogyo K.K.) and a mixture of 100 wt. parts of fluorine-containing latex ("GL213", Daikin Kogyo K.K.), 5 wt. parts of FEP powder ("NDI", Daikin Kogyo K.K.) and 5 wt. parts of hardener), followed by baking to form a ca. 20 μm-thick layer, which was then further coated with a ca. 5 μm-thick layer of FEP ("NDI", Daikin Kogyo K.K.), followed by surface-smoothing treatment as in Example 1. The thus-obtained pressure roller exhibited a micro-hardness of 43 deg., a contact angle with water of 110 deg. and a surface roughness (Rz) of 0.8 μm.

COMPARATIVE EXAMPLE 2

An aluminum cylinder of 260 mm in length was coated with a 3.5 mm-thick elastic layer of silicone rubber ("DY35-561A/B") to provide a roller of 20 mm in outer diameter and 230 mm in coated elastic layer length. The coated roller was further coated with an adhesive (GLP-103", mfd. by Daikin Kogyo K.K.) and a mixture of 100 wt. parts of fluorine-containing latex ("GL213", Daikin Kogyo K.K.), 5 wt. parts of FEP powder ("NDI", Daikin Kogyo K.K.) and 10 wt. parts of hardener), followed by baking to form a ca. 30 μm-thick layer, which was then further coated with a ca. 10 μm-thick layer of FEP ("NDI", Daikin Kogyo K.K.), followed by surface-smoothing treatment as in Example 1. The thus-obtained pressure roller exhibited a micro-hardness of 54 deg., a contact angle with water of 112 deg. and a surface roughness (Rz) of 0.5 μm.

COMPARATIVE EXAMPLE 3

An aluminum cylinder of 260 mm in length was coated with a 3.5 mm-thick elastic layer of silicone rubber ("DY35-561A/B") to provide a roller of 20 mm in outer diameter and 230 mm in coated elastic layer length. The coated roller was further coated with an adhesive (GLP-103", mfd. by Daikin Kogyo K.K.) and a mixture of 100 wt. parts of fluorine-containing latex ("GL213", Daikin Kogyo K.K.), 5 wt. parts of FEP powder ("NDI", Daikin Kogyo K.K.) and 5 wt. parts of hardener), followed by baking to form a ca. 5 μm-thick layer, which was then further coated with a ca. 5 μm-thick layer of FEP ("NDI", Daikin Kogyo K.K.), followed by surface-smoothing treatment as in Example 1. The thus-obtained pressure roller exhibited a micro-hardness of 39 deg., a contact angle with water of 100 deg. and a surface roughness (Rz) of 4.2 μm.

Figure 3:
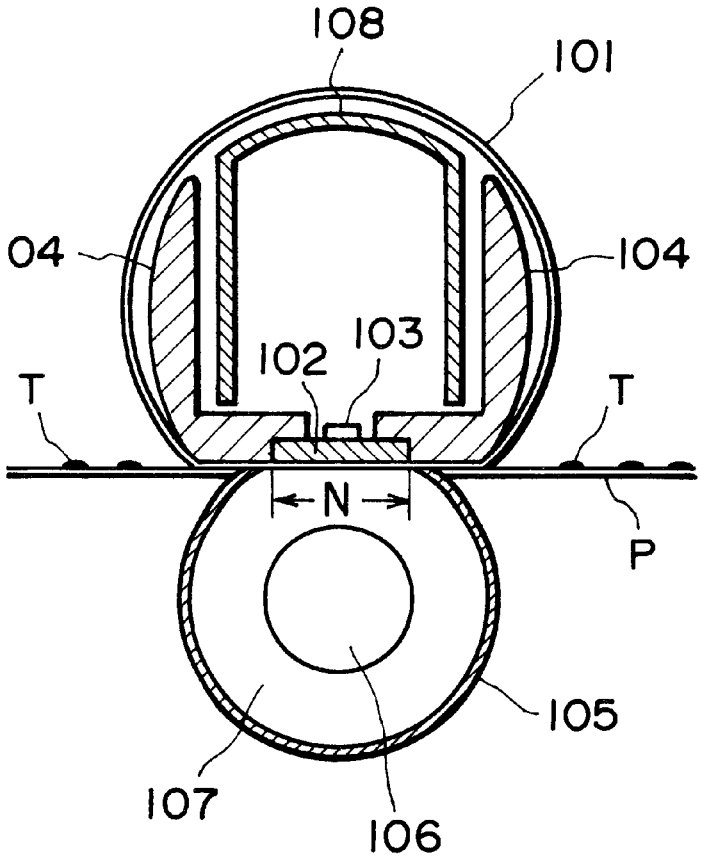
FIG. 3 illustrates an organization of a known heat-fixing device.
Figure 4:
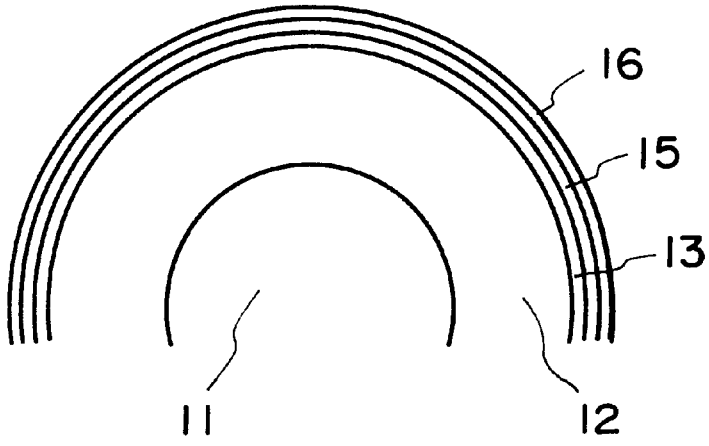
FIG. 4 is a partial schematic sectional view of another embodiment of the pressure roller according to the invention.

Each of the pressure rollers obtained in the above Example 3 and Comparative Examples 2 and 3 was incorporated as a pressure roller in a fixing device shown in FIG. 3 and subjected to performance evaluation in a fixing test as follows.

The fixing test was performed in an environment of 10° C./15% RH for fixation of unfixed toner images formed by a laser beam printer ("Laser Shot LBP 320") on more than 5000 sheets of paper (basis weight: 80 g/m$^2$, "X9000" mfd. by Boise Cascade Co.). This type of paper was used because it contained both calcium carbonate and talc as fillers.

As a result of the test, the pressure roller of Example 3 resulted in the soiling on the roller or no soiling on the resultant images even after supply of paper sheets in excess of 5000 sheets. On the other hand, the pressure roller of Comparative Example 2 became slightly soiled after ca. 300 sheets and exhibited soiling over a wide area to result in attached toner particles at non-image parts on the paper sheets after the fixation. Further, the pressure roller of Comparative Example 3 became slightly solid after ca. 1000 sheets and exhibited soiling over a wide area.

Figure 5:
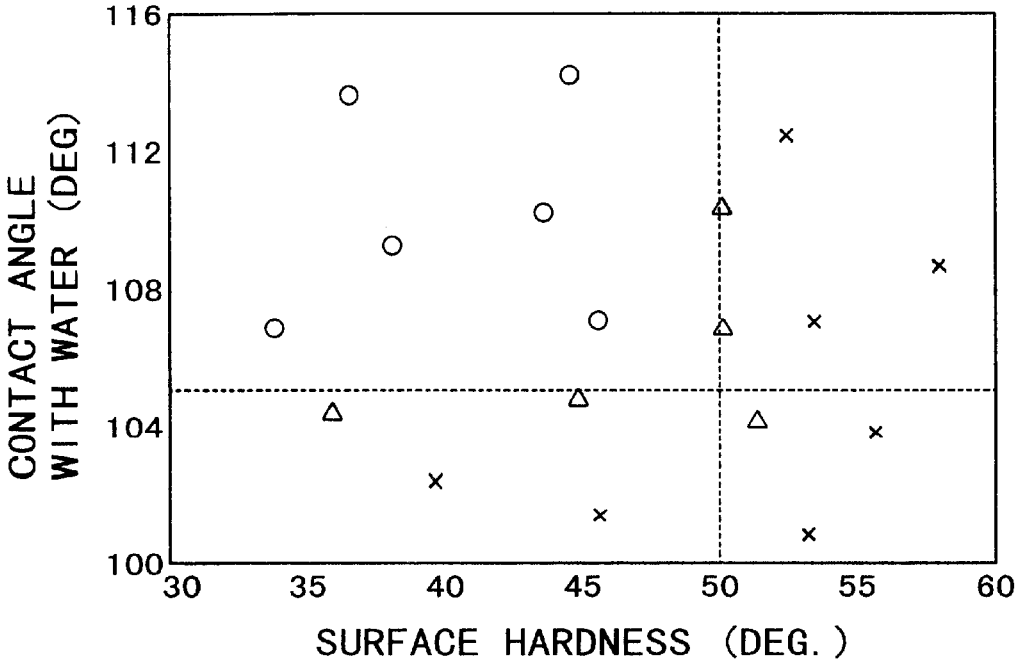
FIG. 5 is a graph showing plots of contact angles with water of pressure roller surfaces and surface hardness of the pressure rollers.

Though Example 3 and Comparative Examples 2 and 3 were described above as representative, but other pressure rollers were also prepared by using various thicknesses of adhesive layers and surface release layers and degrees of surface-smoothing treatments. The results of performance evaluation in the above-described manner are summarized in FIGS. 5 and 6. More specifically, FIG. 5 shows the performance evaluation results on a graph with an abscissa of roller surface hardness and an ordinate of contact angle with water. In FIG. 5, each spot ○ represents that toner soiling did not occur until 5000 sheets, each spot Δ represents that toner soiling occurred at 3000 sheets, and each spot X represent that toner soiling occurred even at an initial stage. As is understood from FIG. 5, toner soiling prevention characteristic is inferior at a contact angle of ca. 105 deg. or below. However, even at a contact angle of 105 deg. or higher, the toner soiling prevention characteristic becomes inferior if the surface hardness exceeds 50 deg. Accordingly, it is understood that a high smoothness and releasability as represented by a large contact angle and a low surface hardness (i.e., softness) are both required for providing a pressure roller exhibiting a good anti-toner soiling characteristic.

Further to say, if the pressure roller surface is soft, it can exhibit good followability with paper and suppress the occurrence of paper dust and toner rubbing function. However, if a lower surface hardness is liable to result in a rougher pressure roller surface, and soiling toner is liable to be accumulated at the resultant concavities. Accordingly, it is necessary to realize a good balance between the pressure roller surface smoothness and hardness, so as to provide a pressure roller exhibiting excellent anti-toner soiling characteristic.

Figure 6:
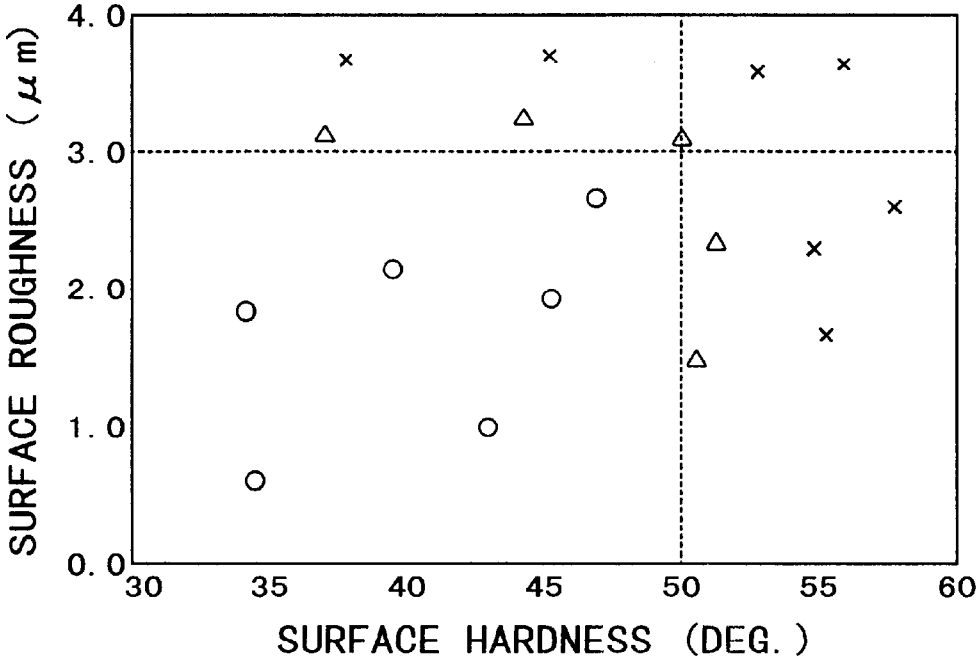
FIG. 6 is a graph showing plots of surface roughness of pressure rollers and surface hardnesses of the pressure rollers.

FIG. 6 shows performance evaluation results on a graph of surface hardness (abscissa) and surface roughness (ordinate) as a measure of surface smoothness instead of contact angle with water. Spots ○, Δ and X represent the same results. FIG. 6 shows that a region of a surface roughness of at most 50 deg. and a surface roughness (Rz) of at most 3.0 μm provided pressure rollers exhibiting excellent anti-toner soiling characteristic.

What is claimed is:

1. A fluorine-containing resin-coated pressure roller, comprising a cylindrical metal substrate, and a rubber elastic layer, an adhesive layer and a fluorine-containing resin release layer disposed in this order on and successively coating the cylindrical metal substrate; wherein the pressure roller has a surface exhibiting a micro-rubber hardness of at most 50 deg., a contact angle with water of at least 105 deg. and a ten point-average surface roughness Rz of at most 3.0 μm.

2. A pressure roller according to claim 1, of which the surface exhibits a micro-rubber hardness of 10–50 deg.

3. A pressure roller according to claim 1, of which the surface exhibits a contact angle with water of 105–130 deg.

4. A pressure roller according to claim 1, of which the surface exhibits a ten point-average surface roughness Rz of 0.1–3.0 μm.

5. A pressure roller according to claim 1, of which the rubber elastic layer comprises silicone rubber exhibiting a JIS-A rubber hardness of 5–20 deg.

6. A pressure roller according to claim 1, wherein the adhesive layer has a thickness of 5–18 μm, and the fluorine-containing resin release layer has a thickness of 1–10 μm.

7. A pressure roller according to claim 1, wherein the adhesive layer comprises a mixture of rubber elastomer and fluorine-containing resin powder disposed therein, and the mixture exhibits a JIS-A rubber hardness of 30 deg.

8. A heat-fixing device, comprising a heating member and a pressure roller according to claim 1.

9. A film heating-type fixing device for use in an electrophotographic image forming apparatus, comprising: a fluorine-containing resin-coated elastic pressure roller and a fixing film having a surface release layer disposed opposite to the pressure roller surface, wherein the surface release layer of the fixing film comprises a fluorine-containing resin and exhibits a ten point-average surface roughness Rz of at most 5 μm; and the fluorine-containing resin-coated pressure roller comprises a cylindrical metal substrate, and a roller elastic layer, an adhesive layer and a fluorine-containing resin release layer disposed in this order on and successively coating the cylindrical metal substrate; wherein the pressure roller has a surface exhibiting a micro-rubber hardness of at most 50 deg., a contact angle with water of at least 105 deg. and a ten point-average surface roughness Rz of at most 3.0 μm.

* * * * *

UNITED STATES PATENT AND TRADEMARK OFFICE

CERTIFICATE OF CORRECTION

PATENT NO. : 6,377,777 B1
DATED : April 23, 2002
INVENTOR(S) : Kazuo Kishino et al.

It is certified that error appears in the above-identified patent and that said Letters Patent is hereby corrected as shown below:

Column 3,
Line 15, "extends" should read -- extending --.

Column 6,
Line 14, "deice" should read -- device --.

Column 9,
Line 10, "comprise" should read -- comprises --.
Line 35, "hating" should read -- heating --.

Column 10,
Line 45, "manners" should read -- manner --.

Signed and Sealed this

Eighteenth Day of June, 2002

*Attest:*

*Attesting Officer*

JAMES E. ROGAN
*Director of the United States Patent and Trademark Office*